US010340071B2

(12) United States Patent
Demersseman

(10) Patent No.: US 10,340,071 B2
(45) Date of Patent: Jul. 2, 2019

(54) MAGNETIC CIRCUIT FOR CARRYING AT LEAST ONE COIL

(71) Applicant: Valeo Systemes de Controle Moteur, Cergy Saint Christophe (FR)

(72) Inventor: Richard Demersseman, Choisy le Roi (FR)

( * ) Notice: Subject to any disclaimer, the term of this patent is extended or adjusted under 35 U.S.C. 154(b) by 699 days.

(21) Appl. No.: 14/653,440

(22) PCT Filed: Dec. 20, 2013

(86) PCT No.: PCT/FR2013/053238

§ 371 (c)(1),
(2) Date: Aug. 17, 2015

(87) PCT Pub. No.: WO2014/096743

PCT Pub. Date: Jun. 26, 2014

(65) Prior Publication Data

US 2015/0364240 A1 Dec. 17, 2015

(30) Foreign Application Priority Data

Dec. 21, 2012 (FR) ..... 12 62532

(51) Int. Cl.

| | |
|---|---|
| ***H01F 27/24*** | (2006.01) |
| ***H01F 27/255*** | (2006.01) |
| ***H01F 3/14*** | (2006.01) |
| ***H01F 27/25*** | (2006.01) |
| ***H01F 27/245*** | (2006.01) |
| ***H01F 27/28*** | (2006.01) |

(Continued)

(52) U.S. Cl.

CPC ..... *H01F 27/255* (2013.01); *H01F 3/14* (2013.01); *H01F 27/245* (2013.01); *H01F 27/25* (2013.01); *H01F 27/2823* (2013.01); *H01F 27/32* (2013.01); *H01F 2003/106* (2013.01); *H01F 2027/2857* (2013.01)

(58) Field of Classification Search

USPC ..... 336/217

See application file for complete search history.

(56) References Cited

U.S. PATENT DOCUMENTS 2,908,880 A * 10/1959 Steinmayer ..... H01F 27/25 336/212
6,980,077 B1 * 12/2005 Chandrasekaran ... H01F 27/255 336/212

(Continued)

FOREIGN PATENT DOCUMENTS

GB 2 442 090 A 3/2008
WO 20051055256 A1 6/2005

OTHER PUBLICATIONS

International Search Report issued in PCT/FR2013/053238 dated Mar. 6, 2014 (3 pages).

*Primary Examiner* — Ronald Hinson
(74) *Attorney, Agent, or Firm* — Osha Liang LLP

(57) ABSTRACT

The invention relates to a magnetic circuit (2) for carrying at least one coil (3), the circuit (2) comprising: at least one inner leg (6) and at least two outer legs (4), and a connecting part (7) for guiding the magnetic flux of the inner leg (6) towards each outer leg (4), none of the outer legs (4) having a gap width and the inner leg (6) being at least partially formed from at least one material having a relative magnetic permeability lower than that of the material(s) forming the outer legs.

14 Claims, 4 Drawing Sheets

(51) Int. Cl.
*H01F 27/32* (2006.01)
*H01F 3/10* (2006.01)

(56) References Cited

U.S. PATENT DOCUMENTS

| | | | | |
|---|---|---|---|---|
| 2002/0039062 | A1 | 4/2002 | Kvarnsjo et al. | |
| 2010/0134044 | A1 | 6/2010 | Sin | |
| 2012/0200382 | A1* | 8/2012 | Hejny | H01F 3/10 336/212 |

* cited by examiner

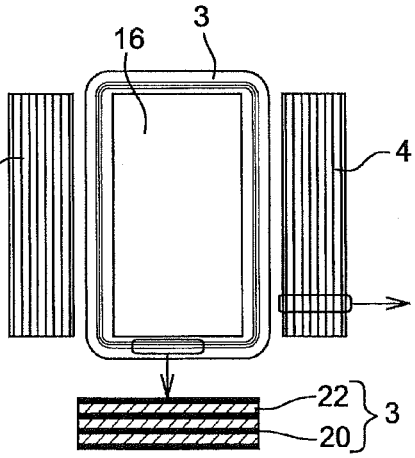
Fig. 7
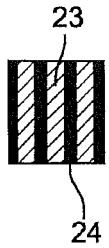
Fig. 6
Fig. 4
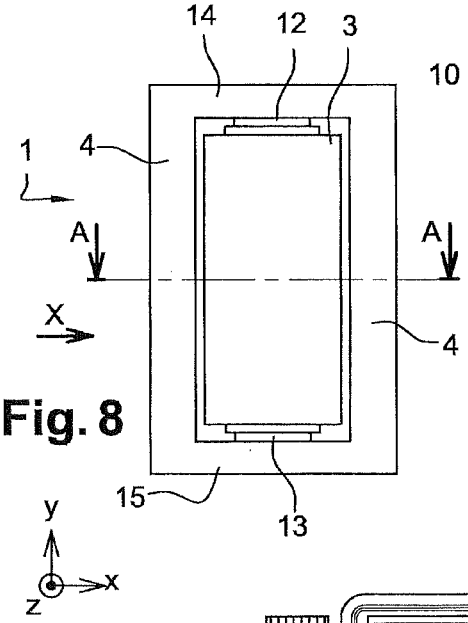
Fig. 8
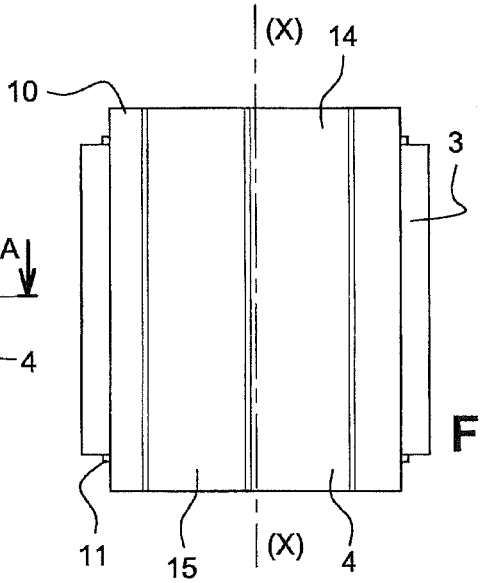
Fig. 10
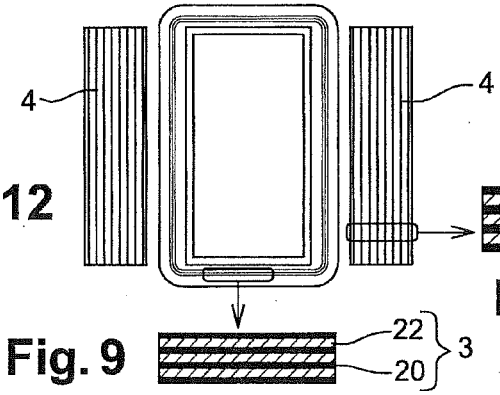
Fig. 12
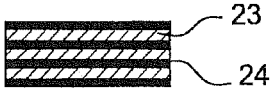
Fig. 11
Fig. 9

MAGNETIC CIRCUIT FOR CARRYING AT LEAST ONE COIL

The present invention relates to a magnetic circuit for carrying at least one coil. The assembly formed by the magnetic circuit and the coil may notably, although not exclusively, belong to a static electric energy convertor such as a DC/DC voltage convertor where it acts as an inductor.

Figure 1:
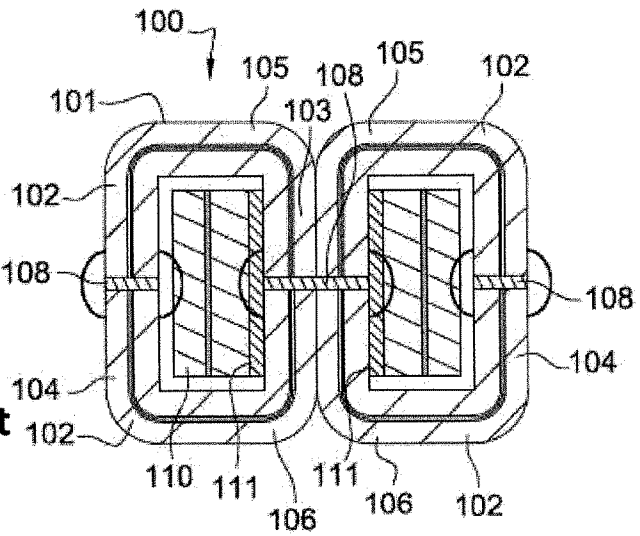
Fig. 1 Prior Art

FIG. 1 depicts one example of a known assembly 100. This assembly 100 comprises a magnetic circuit 101 comprising four U-shaped magnetic elements 102. These four elements 102 define: an inner leg 103, two outer legs 104 arranged one on each side of the inner leg 103 and two connecting parts 105 and 106.

As can be seen in FIG. 1, the inner leg 103 and the outer legs 104 each comprise a non-magnetic element 108 arranged between two magnetic elements 102 to form a non-magnetic gap. Each non-magnetic element 108 is, for example, a block of resin.

An electrically conducting coil 110 is wound around the inner leg 103, this coil 110 being electrically insulated from this leg 103 by an insulating support 111. The coil 110 is, for example, obtained by winding an electrically conducting strip covered with an insulator on one of its faces.

The assembly 100 is housed in a casing externally surrounding all or part of the outer legs 104 and connecting parts 105 and 106. Such a casing, used in conjunction with a resin which electrically insulates it from the coil 110, may allow the assembly 100 to be cooled or protected against attack from the external environment, for example with respect to moisture, dust, etc.

When used in a static electrical energy convertor, the assembly 100 typically has an AC current passing through it. This current is a source of alternating magnetic flux in the magnetic circuit 101. This flux "strays" out of the non-magnetic gaps of the outer legs 104 and of the inner leg 103, whereas it remains well "contained" inside the magnetic elements 102.

This straying of the flux out of the non-magnetic gaps of the outer legs 104, combined with the fact that the assembly 100 is housed in a casing adjacent to each outer leg, may present problems. Specifically, this stray flux may pass through certain parts of the casing and, because of its alternating nature and the conducting nature of the material of the casing, induce eddy currents therein, such currents giving rise to Joule energy losses, hence a loss of energy through undesired heating of the casing.

Irrespectively of the presence of the casing, the straying of the magnetic flux out of the non-magnetic gaps of the outer legs 104 and of the inner leg 103 causes this flux to pass through certain regions of the coil 110. Because of the heating caused by the eddy currents, the aging of the insulation between turns in these regions may be more rapid than in the rest of the coil 110, causing the life of the assembly 100 to be degraded.

There is a need to enjoy a magnetic circuit for carrying at least one coil, that overcomes the abovementioned disadvantages, notably so that it can be used on an industrial scale as an inductor, particularly for the static conversion of electrical energy in a hybrid or electric motor vehicle.

The invention seeks to address this need and in one of its aspects achieves this using a magnetic circuit for carrying at least one coil, the circuit comprising:

at least one inner leg and at least two outer legs, and a connecting part serving to guide the magnetic flux from the inner leg to each outer leg, each outer leg having no non-magnetic gap and the inner leg being at least partially made from one or more materials that have a relative magnetic permeability that is lower than that of the materials of which the outer legs are formed.

Because of the absence of a non-magnetic gap in the outer legs, the risks of the magnetic flux flowing through the outer legs straying from said legs toward the casing and/or toward the coil or coils carried by the magnetic circuit are reduced. In this way, the risk of eddy currents appearing in the casing or in the coil or coils and, therefore, the risk of heating as mentioned hereinabove is avoided.

Creating the inner leg according to the invention also allows better channeling of the magnetic flux within this leg at said portion or part, the magnetic permeability of which is reduced, making it possible to reduce the straying of the magnetic flux from said inner leg toward the coil or coils carried by the circuit and thus making it possible to reduce the risk of heating via eddy currents.

Said portion therefore forms a non-magnetic gap in the inner leg.

Within the meaning of the present application, "inner leg" refers to that part of the magnetic circuit one side of which faces an outer leg and the other side of which faces another leg, and "outer leg" refers to that part of the magnetic circuit that has one side facing the inner leg and the opposite other side of which defines an exterior surface of the assembly. Those sides of an inner leg and of an outer leg that face one another are separated by a space that part of one or more coils can occupy.

It is possible for said portion of the inner leg to form just a fraction of the inner leg or, as an alternative, to form the entirety of the inner leg.

Said portion of the inner leg may be formed of a single material or by several sections, each section then being made of a given material. When several materials are used to form said portion of the inner leg, the relative magnetic permeability of each of these materials may be lower than that of the material or materials of which the outer legs are formed.

Each outer leg may be made as a single piece in one and the same material from one outer leg to the other and the relative magnetic permeability of the material of said portion of the inner leg may be lower than the relative magnetic permeability of the material of the outer legs.

The ratio between the relative magnetic permeability of the material of said portion of the inner leg and the relative magnetic permeability of the material of the outer legs may be comprised between 0.1 and 0.01, or may even be comprised between 0.1 and 0.001. In this way it is possible to ensure that the magnetic field is sufficiently well channeled in the inner leg of the magnetic circuit. By way of example, the relative magnetic permeability of the material or materials of which said portion of the inner leg is formed may be comprised between 6 and 20 and the relative magnetic permeability of the material or materials of which the outer legs are formed may be at least 600.

When use is made of a different material from one outer leg to the other or when each outer leg comprises sections made of different materials, the relative magnetic permeability of the material of said portion of the inner leg may be lower than the minimum value for the relative magnetic permeability of the materials used for the outer legs. The abovementioned range of values for the relative magnetic permeability ratio, namely [0.01; 0.1] or [0.001; 0.1] may then apply between the relative magnetic permeability value of said portion of the inner leg and the minimum relative magnetic permeability value for the outer legs.

The material of said portion of the inner leg may be a magnetic powder. The latter may have been previously molded then compacted to form said portion.

The magnetic powder may have a relative magnetic permeability of between a few units and a few hundreds of units, for example between 6 and 100.

The connecting part may comprise at least one portion made from the same material or materials as said portion of the inner leg. This portion of the connecting part may or may not be adjacent to the junction between the inner leg and the connecting part. The rest of the connecting part may or may not be made from the same material as the outer legs.

As an alternative, the entirety of a connecting part is made from the same material or materials as those used to make the outer legs, so that the zone of the magnetic circuit, the relative magnetic permeability of which is reduced, is located exclusively in the inner leg.

Each one of the inner leg and outer legs may extend parallel to one and the same longitudinal axis between a first end and a second end, and the connecting part may comprise a first part connecting the first ends together and a second part connecting the second ends together. This longitudinal axis then constitutes the longitudinal axis of the magnetic circuit.

In what follows, a transverse section is a section perpendicular to the longitudinal axis.

When the inner leg is in the form of a straight bar, the ratio between the length of said leg and the length of said portion may be comprised between 0.1 and 1, for example being equal to 1.

In one particular example, each end of the inner leg may have a transverse section that varies along the longitudinal axis. The transverse section of the ends may thus decrease with increased proximity to the corresponding connecting part. Each end of the inner leg may comprise several successive transverse sections which are homothetic images of one another with a ratio of less than one from one section to the other with increasing proximity to the corresponding connecting part. As an alternative, at least one of the transverse sections of the first or of the second end of the inner leg may have a shape different from the shape of the other transverse sections of said end.

According to one exemplary embodiment of the invention, each outer leg may be formed from a magnetic strip wound about an axis. According to this exemplary embodiment of the invention, said axis of winding may be perpendicular to the longitudinal axis of the magnetic circuit and possibly does not simultaneously intersect the inner leg and either of the outer legs. According to another exemplary embodiment of the invention, each outer leg may be formed of a stack of magnetic laminations. According to this other exemplary embodiment of the invention, said laminations may be stacked along an axis of stacking perpendicular to the longitudinal axis and not simultaneously intersecting the inner leg and either of the outer legs.

According to this other exemplary embodiment of the invention, the magnetic circuit may have a shape very close to that of a parallelepiped, or may even have exactly a parallelepipedal shape. Thus, when, for a given application, a combination of magnetic circuits, each one carrying one or more coils, is required, this combination can be arranged in the form of a compact block of one or more rows of magnetic circuits, the parallelepipedal shape thereof making it possible to reduce the "unused" volume corresponding to the gaps between magnetic circuits, notably to the "strict minimum" imposed by electrical insulation and heat dissipation requirements.

Such a combination of parallelepipedal magnetic circuits may also prove advantageous in instances in which a metal casing is required, for the reasons mentioned hereinabove for example, i.e. of cooling and protection. Use can be made of a single metal casing of which the parts surrounding the magnetic circuits will be able to occupy the gaps mentioned hereinabove, together with the electrically insulating resin.

According to this other exemplary embodiment of the invention, each outer leg may be formed as a specific component, just like the first and second connecting parts.

As an alternative, the connecting part may be formed of three distinct pieces, a first component being in contact with one end of the inner leg and being arranged between a second component and a third component. The second component and the third component may have an elongate part and two returns separated by the elongate part, and notably perpendicular to this elongate part. The elongate part may define the entirety of an outer leg, a return may define the fraction of the first connecting part adjacent to said outer leg, and the other return may define the fraction of the second connecting part adjacent to said outer leg.

The magnetic circuit may form a shell.

A further subject of the invention, in another of the aspects thereof, is an assembly comprising:

a magnetic circuit as defined hereinabove, and at least one electrically conducting coil carried by the magnetic circuit.

The assembly may form one or more inductors, as explained hereinafter.

The coil may be formed by winding an electrically conducting wire.

As an alternative, the coil may be formed of a metal tape that is electrically insulated on one of its two faces (better known as a "foil").

The coil may be wound around a zone of the inner leg. Said zone may or may not coincide with said inner leg portion. The coil is, for example, wound around less than the length of the inner leg.

It is possible for the coil or coils not to be encapsulated in the magnetic circuit, namely for one or more portions of the coil or coils not to be covered by the magnetic circuit, the latter then not acting as a shield between said portions of the coil or coils and the exterior of the assembly.

The coil may be a single coil, in which case a single inductor is formed by the assembly.

As an alternative, the magnetic circuit may carry several coils, in which case the assembly may form several inductors. These inductors can then be coupled.

When the magnetic circuit carries several coils, the latter may be wound around one of the following zones of the magnetic circuit: a zone of one of the outer legs or a zone of a connecting part.

The assembly comprises for example four coils and each of them may be wound around a zone of the connecting part. One of the coils is, for example, wound around a zone of the first connecting part between the first end of the inner leg and the first outer leg, another coil is, for example, wound around a zone of the first connecting part between the first end of the inner leg and the second outer leg, another coil is, for example, wound around a zone of the second connecting part between the second end of the inner leg and the first outer leg and the last coil is, for example, wound around a zone of the second connecting part between the second end of the inner leg and the second outer leg.

When four coils are carried by the magnetic circuit, two of these coils may be electrically connected to one another. In the four-coil example above, the coils positioned near one and the same outer leg may be electrically connected to one another so that the assembly forms two coupled inductors.

In an alternative form whereby the magnetic circuit comprises two inner legs, six coils can be carried by the magnetic circuit and a first inductor is formed by three coils electrically connected in series and a second inductor is formed by the other three coils electrically connected in series.

In another alternative form whereby the magnetic circuit comprises two inner legs, six coils can be carried by the magnetic circuit and three inductors can be formed by electrically connecting the coils in series in pairs.

The inductance of a coil may be comprised between 100 and 500 μF, being, for example, of the order of 450 μF.

In another of its aspects, another subject of the invention is a static electrical energy convertor comprising at least one assembly as defined hereinabove.

The convertor may be a voltage convertor. It is, for example, a DC/DC voltage convertor making it possible for example to raise a voltage of 300 V to a value of 800 V. The chopping frequency of this convertor may be higher than 1 kHz, being for example comprised between 1 and 100 kHz, and notably of the order of 20 kHz.

This DC/DC voltage convertor forms for example part of an electrical circuit used to exchange electrical energy between an electrical energy storage unit and an electric motor of a hybrid or electric vehicle carried on board the vehicle. As an alternative, this DC/DC voltage convertor may form part of an electric circuit used for exchanging electrical energy between an electrical mains external to the vehicle and an electrical energy storage unit on board the vehicle.

As a further alternative, the DC/DC voltage convertor forms part of an electric circuit on board an electric or hybrid vehicle and used both for exchanging electrical energy between an electrical energy storage unit and an electric motor and for exchanging electrical energy between an electric mains external to the vehicle and the electrical energy storage unit.

As a further alternative the above assembly may be associated with an inverter.

Figure 2:
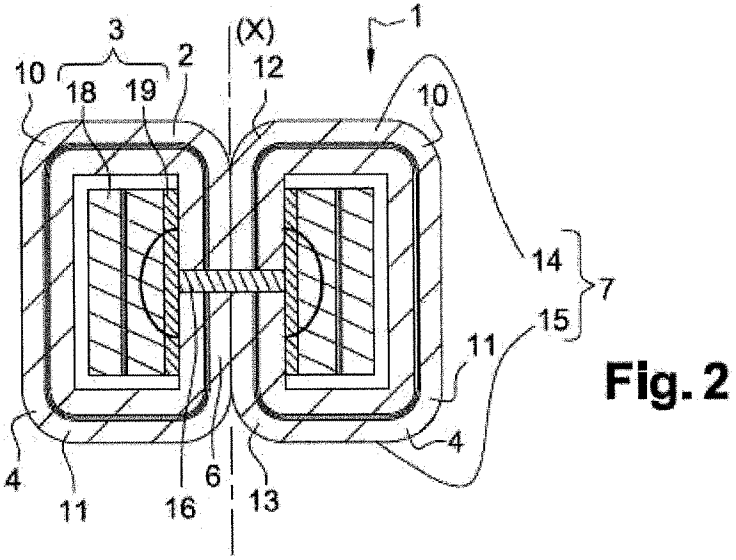
Figure 3:
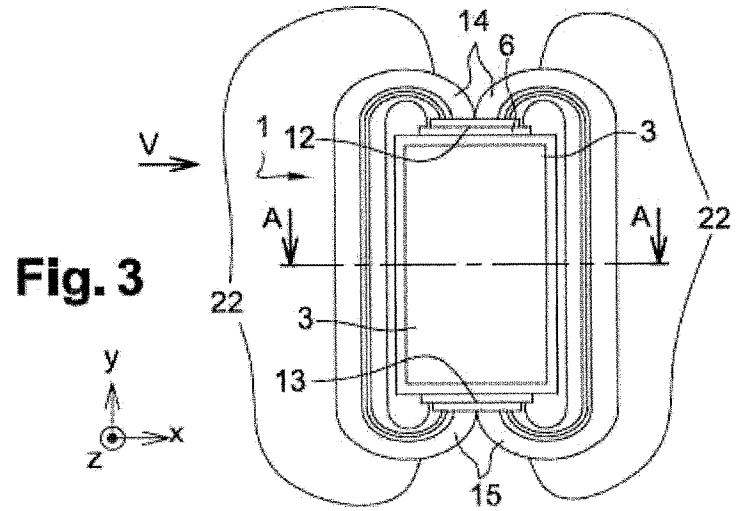
Figure 5:
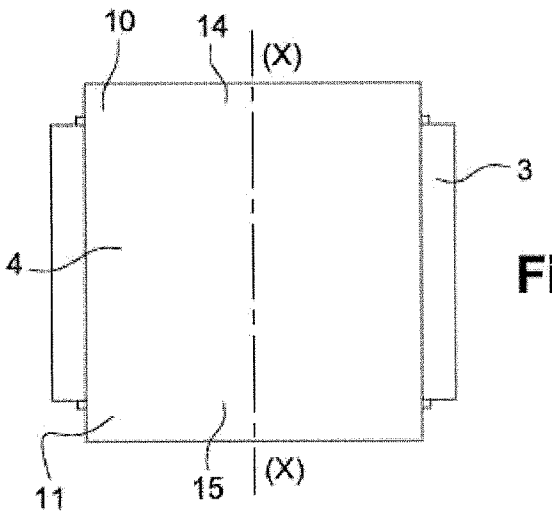

The invention may be better understood from reading the following description of one nonlimiting exemplary embodiment thereof and from studying the attached drawing in which:

FIG. 1 has already been described,

FIG. 2 is a schematic and not-to-scale depiction of one example of an assembly according to the invention in a depiction similar to that of FIG. 1, FIGS. 3 to 7 depict an assembly according to a first exemplary embodiment of the invention, FIG. 3 depicting the assembly face-on, FIG. 4 depicting a detail of the coil of the assembly of FIG. 3, FIG. 5 being a view on V of the assembly of the figure, FIG. 6 being a view of part of the outer leg of the assembly of FIG. 3, and FIG. 7 is a section on A-A of the assembly of FIG. 3, FIGS. 8 to 12 depict an assembly according to a second exemplary embodiment of the invention, FIG. 8 depicting the assembly face-on, FIG. 9 depicting a detail of the coil of the assembly of FIG. 8, FIG. 10 being a view on X of the assembly of FIG. 8, FIG. 11 being a view of part of the outer leg of the assembly of FIG. 8, and FIG. 12 is a section on A-A of the assembly of FIG. 8, FIGS. 13 to 17 depict alternative forms of embodiment of the assembly depicted in FIG. 8, and FIGS. 18 to 20 depict an assembly according to another exemplary embodiment of the invention.

FIG. 2 very schematically and not to scale depicts one example of an assembly 1 according to the invention, for the purposes of comparing it with that depicted in FIG. 1.

The assembly 1 comprises a magnetic circuit 2 and one single coil 3 in the example described. As may be seen, the magnetic circuit 2 comprises two outer legs 4 and an inner leg 6 which is positioned between the two outer legs 4. A connecting part 7 guides the magnetic flux from the inner leg 6 toward each outer leg 4. As depicted in this FIG. 2, each outer leg 4 is produced here as a single piece, with no non-magnetic gap.

As can be seen in FIG. 2, each outer leg 4 and the inner leg 6 may extend parallel to one and the same straight longitudinal axis X, between two ends 10 and 11 in the case of the outer legs 4, and 12 and 13 in the case of the inner leg 6.

The connecting part 7 may then comprise a first connecting part 14 connecting the first ends 10 and 12 together and a second connecting part 15 connecting the second ends 11 and 13 together. In the example considered, the first connecting part 14 and second connecting part 15 extend transversely with respect to the axis X, notably perpendicular to this axis X.

The inner leg 6 comprises a portion 16 made from a material different from that used to make the rest of the magnetic circuit 2 depicted in FIG. 2.

The portion 16 is made for example of a magnetic powder. The powder may have been molded then compacted beforehand in order to create this portion 16. By way of powder use is made for example of the powder marketed by the company Magnetics® under the reference "XFlux 60μ". The magnetic powder may have a relative magnetic permeability comprised between a few units and a few hundreds of units, for example between 6 and 100. The rest of the magnetic circuit 2 is made of magnetic laminations, for example marketed by the company JFE® under the reference "10JNHF600". There is a ratio comprised between 0.1 and 0.01, for example, between the relative magnetic permeability of the portion 16 and that of the material used to make the outer legs 4 and the connecting part 7 of the magnetic circuit 2 of FIG. 2.

The coil 3 is a single coil in the example of FIG. 2 and is wound around the inner leg 6. The coil 3 in this example is of the "foil" type, which means to say that it is made of a strip 18, one of the faces of which is covered with an insulating layer 19. The strip 18 is made for example of copper or of aluminum.

The assembly 1 is placed in a casing, not depicted, used both to cool the assembly 1 and to protect it against attack from the external environment.

As may be seen in FIG. 2 very schematically, because of the absence of a non-magnetic gap in the outer legs 4 and because of the presence of the portion 16 in the inner leg 6, the magnetic flux remains well contained within the outer legs 4, stray magnetic flux outside of these legs being reduced very significantly.

An assembly 1 according to a first exemplary embodiment of the invention will now be described with reference to FIGS. 3 to 7.

This assembly 1, viewed face-on in FIG. 3, comprises a single coil 3 wound around the inner leg 6. In this example, the coil 3 is formed of an electrically conducting strip 20 coated with an electrical insulator 22, as can be seen in FIG. 4 which depicts in detail part of the coil 3 of the assembly of FIG. 3. As depicted in FIG. 3, the coil 3 in this example is not encapsulated in the magnetic circuit 2.

Still according to the example of FIG. 3, the portion 16 defines the entirety of the inner leg 6, which means to say that the inner leg 6 is wholly formed by the portion 16.

It may also be seen in FIG. 3 that the ends 12 and 13 of the inner leg 6 are free, not being covered by the coil 3.

According to this first exemplary embodiment of the invention, the rest of the magnetic circuit 2 is obtained from two soft magnetic strips 22. Once shaped, these two strips are C-shaped, one of the strips forming an outer leg 4 and having:

- a return extending transversely to said outer leg to form that fraction of the first connecting part 14 that is situated between said outer leg 4 and the inner leg 6, and
- a return extending transversely to said outer leg 4 to form that fraction of the second connecting part 15 that is situated between said outer leg 4 and the inner leg 6.

The other strip forms the other outer leg 4 and likewise has:

- a return extending transversely to said outer leg 4 to form that fraction of the first connecting part 14 that is situated between said other outer leg 4 and the inner leg 6, and
- a return extending transversely to said outer leg 4 to form that fraction of the second connecting part 15 that is situated between said other outer leg 4 and the inner leg 6.

Each outer leg 4 as well as the fraction of the first connecting part 14 and the fraction of the second connecting part 15 that is positioned between said outer leg 4 and the inner leg 6 is obtained by winding a soft magnetic tape 22 around an axis Z situated in a plane perpendicular to the longitudinal axis X and not simultaneously intersecting both the inner leg 6 and either of the outer legs 4.

As may be seen in FIG. 5, which is a side view on V of the assembly 1 of FIG. 3, each outer leg 4 extends beyond the coil 3 via its first 10 and second 11 ends. By contrast, the coil 3 may extend beyond the outer legs 4 on each side thereof on either side of the longitudinal axis X, as depicted in FIG. 5.

FIG. 6 depicts a detail of FIG. 3 showing the makeup of the outer legs 4 and of the connecting parts 14 and 15 according to this first exemplary embodiment of the invention, these being made up of layers of magnetic material 23 alternating with non-magnetic layers 24.

An assembly 1 according to a second exemplary embodiment of the invention will now be described with reference to FIGS. 8 to 12.

This second exemplary embodiment differs from the one that has just been described with reference to FIGS. 3 to 7 through the configuration of the outer legs 4 and of the connecting parts 14 and 15.

The outer legs 4 and the first 14 and second 15 connecting parts are obtained here by stacking magnetic laminations in a direction perpendicular to the axis X and not simultaneously intersecting the inner leg 6 and either of the outer legs 4, this direction being the axis Z in FIG. 8.

The outer legs 4 and the first 14 and second 15 connecting parts are therefore formed by layers of magnetic material 23 alternating with layers of magnetic insulator 24.

The assembly 1 according to this second exemplary embodiment of the invention has a shape that is parallelepipedal overall.

Various alternative forms according to the second exemplary embodiment of the invention will now be described with reference to FIGS. 13 to 17.

Figure 13:
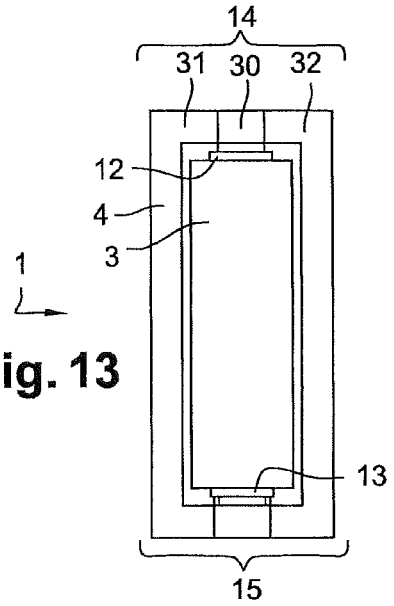
Figure 14:
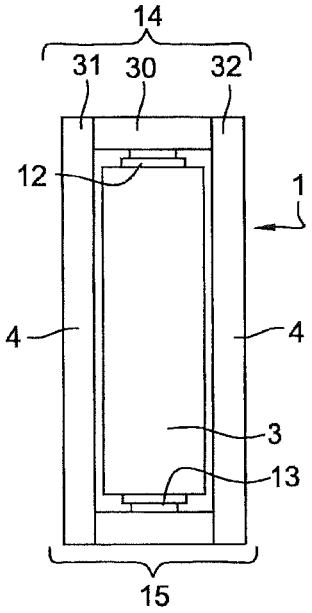

In FIGS. 13 and 14, each end 12 and 13 of the inner leg 6 comprises successive transverse sections that decrease with increased proximity to the corresponding connecting part 14 or 15.

In the example of FIG. 13, the first connecting part 14 comprises three sections:

- a first section 30 facing the first end 12 of the inner leg 6,
- a second section 31 forming one end of the first connecting part 14 and belonging to a component that also forms an outer leg 4 and one end of the second connecting part 15, and
- a third section 32 that forms the other end of the first connecting part 14 and belongs to a component that also forms the other outer leg 4 and the other end of the second connecting part 15, the first section 30 being positioned between the sections 31 and 32.

In the example of FIG. 14, the first connecting part 14 also comprises three sections 30 to 32 but these are straight, having the form of bars with no return.

Figure 15:
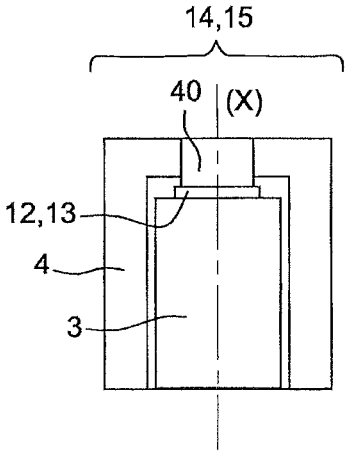
Figure 16:
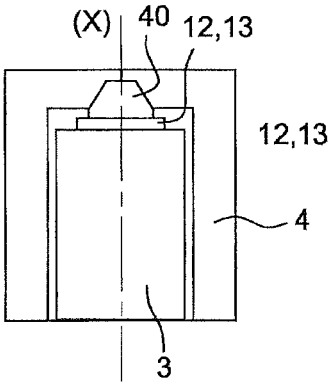
Figure 17:
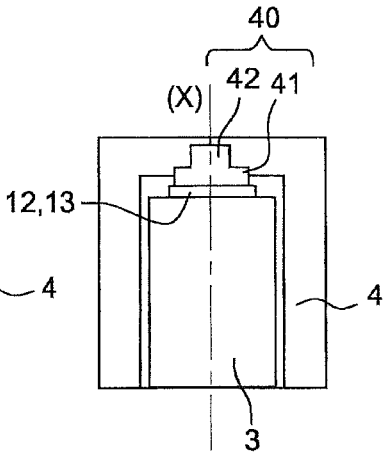

As depicted in FIGS. 15 to 17, the first 14 and second 15 connecting parts may have portions 40 facing the ends 12 and 13 of the inner leg 6 which are made from a material different from the material used to form the rest of said parts 14 or 15. When magnetic powder is used to form the inner leg 6, these portions 40 may be made of powder likewise, notably using the same powder. There may therefore be continuity between the portion 16 of the inner leg 6 and the portions 40 of the connecting parts 14 and 15.

The portions 40 may extend along the axis X, from one edge of each connecting part 14 or 15 to the other, or otherwise.

In the example of FIG. 15, each end 12 or 13 of the inner leg 6 has a transverse section that varies with increasing proximity to the adjacent connecting part 14 or 15. The transverse section may vary in decreasing steps with increased proximity to the corresponding connecting part, forming a staircase appearance visible in FIG. 15. The portion 40 of each connecting part 14 or 15 in this example has a transverse section that is constant, this transverse section being equal to the final transverse section of the end 12 or 13 of the inner leg 6.

In the example of FIG. 16, unlike that of FIG. 15, the portion 40 has a transverse section that decreases continuously to zero, having a pyramid shape when viewed at right angles to the axis X.

In the example of FIG. 17, the portion 40 comprises, in succession, with decreasing proximity to the inner leg 6, a first section 41, the transverse section of which is the same as that of the end 12 or 13 of the inner leg 6 and a second section 42, the transverse section of which is a homothetic image with a ratio of less than one of that of the section 41.

In other alternative forms which have not been depicted, the first 14 and second 15 connecting parts have no portion 40 and the end 12 or 13 of the inner leg 6 is made of the same material as the outer legs 4 and as the connecting parts 14 and 15.

In the examples that have just been described, just one coil 3 is carried by the magnetic circuit 2 and this coil is wound around all or part of the length of the inner leg 6.

However, the invention is not restricted to these examples as will now be seen.

Figure 18:
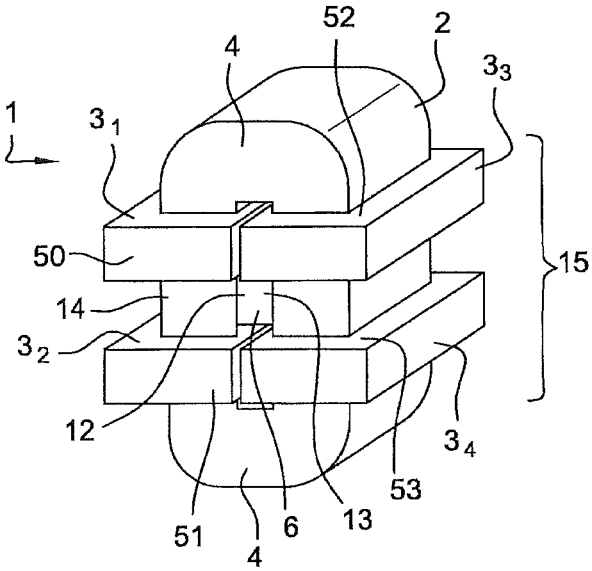
Figure 19:
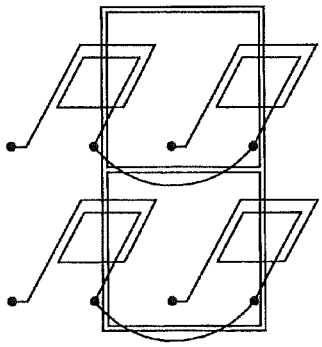

FIGS. 18 and 19 illustrate another example of an assembly 1. In these figures, four coils 3 are carried by the magnetic circuit 2. None of these coils 3 is wound around the inner leg 6.

In FIG. 18, one of the coils $3_1$ is wound around a zone 50 of the first connecting part 14 between the first end 12 of the inner leg 6 and one of the outer legs 4, another coil $3_2$ is wound around a zone 51 of the first connecting part 7 between the first end 12 of the inner leg 6 and the other outer leg 4, another coil $3_3$ is wound around a zone 53 of the second connecting part 15 between the second end 13 of the inner leg 6 and the outer leg 4 adjacent to the coil $3_1$ and the last coil $3_4$ is wound around a zone 53 of the second connecting part 15 between the second end 13 of the inner leg 6 and said other outer leg 4.

As depicted in FIG. 19, the coils $3_1$ and $3_3$ are electrically connected to one another to form just one single inductor and the coils $3_2$ and $3_4$ are likewise electrically connected to one another.

The assembly 1 according to FIGS. 18 and 19 therefore forms two inductors. The assembly 1 may be as described with reference to FIGS. 14 to 16 of the application filed in the name of the applicant company at the European patent office under number EP 11 188922.6. The content of this application is incorporated by reference into the present application, at least insofar as FIGS. 14 to 16 of this application are concerned.

Figure 20:
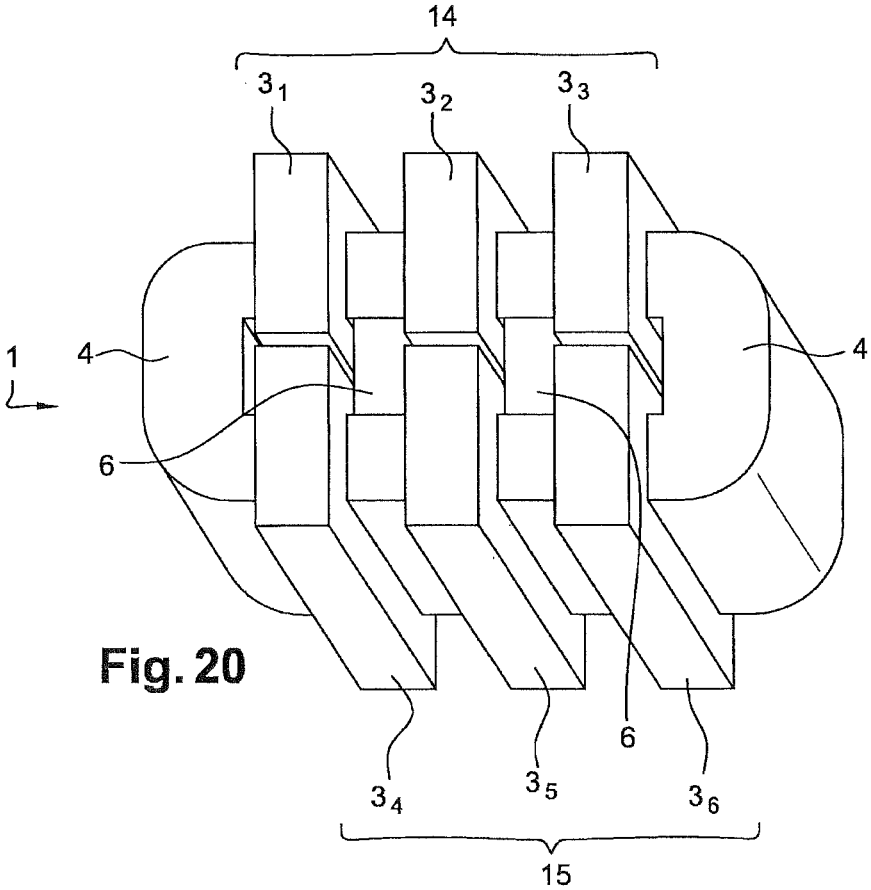

In another alternative form depicted in FIG. 20, six coils $3_1$ to $3_6$ may be carried by the magnetic circuit 2 which then comprises two inner legs 6. Of these six coils, three are electrically connected in series to form one inductor, just like the three remaining coils which form another inductor. Three coils $3_1$ to $3_3$ are, for example, carried by the first connecting part 14 and electrically connected in series while the other three coils $3_4$ to $3_6$ are carried by the second connecting part 15 and electrically connected in series.

In yet another alternative form similar to the one depicted in FIG. 20, three inductors are formed by connecting the coils $3_1$ to $3_6$ in series in pairs.

The assembly 1 that has just been described may, when the magnetic circuit 2 carries just one single coil, have an inductor having an inductance of around 450 μH. This inductor may be incorporated into a DC/DC voltage convertor operating at a chopping frequency of 20 kHz with a duty cycle of 0.66 in order to convert a voltage of 300 V into a voltage of 800 V, for example. The voltage convertor for example forms part of an electric vehicle inverter/charging circuit, for example as disclosed in application WO 2010/057893.

The invention is not restricted to the examples that have just been described.

The expression "comprising a/an" is to be understood as being synonymous with the expression "comprising at least a/an/one" unless specified to the contrary.

The invention claimed is:

1. A magnetic circuit for carrying at least one coil, the circuit comprising:

at least one inner leg and at least two outer legs; and a connecting part serving to guide the magnetic flux from the inner leg to each outer leg, each outer leg having no non-magnetic gap and the inner leg being at least partially made from one or more materials that have a relative magnetic permeability that is lower than that of the material or materials of which the outer legs are formed, each outer leg being made as a single piece in one and the same material from one outer leg to the other and the relative magnetic permeability of the material of a portion of the inner leg being lower than the relative magnetic permeability of the material of the outer legs, the ratio between the relative magnetic permeability of the material of said portion of the inner leg and the relative magnetic permeability of the material of the outer legs being comprised between 0.001 and 0.033, and wherein the inner leg comprises a plurality of successive transverse sections that are homothetic images of one another, having a ratio of less than one from one section to an adjacent section of the plurality of successive transverse sections with increasing proximity to the connecting part.

2. The magnetic circuit as claimed in claim 1, the material of said portion of the inner leg being a magnetic powder.

3. The magnetic circuit as claimed in claim 1, the connecting part comprising at least one portion made from the same material or materials as said portion of the inner leg.

4. An assembly comprising:

a magnetic circuit as claimed in claim 1, and at least one electrically conducting coil carried by the magnetic circuit.

5. The assembly as claimed in claim 4, the coil being formed by winding an electrically conducting wire or by a metal strip that is electrically insulated on one of its two faces.

6. The magnetic circuit as claimed in claim 1, each one of the inner leg and outer legs extending parallel to one and the same longitudinal axis between a first end and a second end, and the connecting part comprising a first part connecting the first ends together and a second part connecting the second ends together.

7. The magnetic circuit as claimed in claim 6, each outer leg being formed from a magnetic tape wound about an axis.

8. The magnetic circuit as claimed in claim 7, said axis of winding being perpendicular to the longitudinal axis and not simultaneously intersecting the inner leg and either one of the outer legs.

9. The magnetic circuit as claimed in claim 6, each outer leg being formed of a stack of magnetic laminations.

10. The magnetic circuit as claimed in claim 9, said laminations being stacked along an axis of stacking perpendicular to the longitudinal axis and not simultaneously intersecting the inner leg and either one of the outer legs.

11. The assembly as claimed in claim 10, the coil being wound around a zone of the inner leg.

12. A static electrical energy convertor comprising at least one assembly as claimed in claim 10.

13. The assembly as claimed in claim 10, comprising several distinct coils.

14. The assembly as claimed in claim 13, the coils being wound around one of the following zones of the magnetic circuit: a zone of one of the outer legs or a zone of the connecting part.

* * * * *